US006409611B1

(12) United States Patent
Louk, Jr.

(10) Patent No.: US 6,409,611 B1
(45) Date of Patent: Jun. 25, 2002

(54) GOLF SWING TRAINING UMBRELLA AND GOLF BALL RETRIEVING DEVICE

(76) Inventor: Richard Louk, Jr., 260 E. Clearview Ave., Worthington, OH (US) 43085

( * ) Notice: Subject to any disclaimer, the term of this patent is extended or adjusted under 35 U.S.C. 154(b) by 20 days.

(21) Appl. No.: 09/671,896

(22) Filed: Sep. 28, 2000

(51) Int. Cl.[7] ..... A63B 57/00; A45B 3/00

(52) U.S. Cl. ..... 473/286; 135/16; 135/19

(58) Field of Search ..... 473/131, 282, 473/286, 226, 219; 135/16, 75, 25.1; 294/19.2

(56) References Cited

U.S. PATENT DOCUMENTS 1,532,802 A * 4/1925 Feistner
2,443,772 A * 6/1948 Mappin
3,868,110 A * 2/1975 Jones
4,511,147 A 4/1985 Olsen
4,790,338 A * 12/1988 Strobl
5,188,409 A * 2/1993 Forey
5,261,434 A 11/1993 Fodero
D365,131 S 12/1995 Edwards et al.
5,476,113 A * 12/1995 Lin et al.
5,480,146 A 1/1996 Comer
5,657,985 A 8/1997 Dahlstrom et al.
D395,477 S 6/1998 Vela
5,839,983 A * 11/1998 Kramer
5,908,214 A * 6/1999 Dinardo
6,045,288 A * 4/2000 Pasternak et al.
6,120,387 A * 9/2000 Bobst

* cited by examiner

*Primary Examiner*—Paul T. Sewell
*Assistant Examiner*—Nini Legesse

(57) ABSTRACT

A golf swing training umbrella and golf ball retrieving device for allowing the user to practice one's golf swing and to retrieve golf balls from the water. The golf swing training umbrella and golf ball retrieving device includes an elongate support assembly having a tubular base member and a plurality of tubular sections telescopingly disposed in said tubular base member and having an innermost tubular section and an outermost tubular section; and also includes a cover support assembly being collapsibly attached to a first end of the tubular base member; and further includes a cover member being securely supported upon said the cover support assembly; and also includes a hand-grip member being securely and removably disposed about the elongate support assembly; and further includes a golf ball retrieval assembly being securely and removably attached to an end of the outermost tubular section.

10 Claims, 5 Drawing Sheets

GOLF SWING TRAINING UMBRELLA AND GOLF BALL RETRIEVING DEVICE

BACKGROUND OF THE INVENTION

1. Field of the Invention

The present invention relates to an umbrella and golf ball retrieving device and more particularly pertains to a new golf swing training umbrella and golf ball retrieving device for allowing the user to practice one's golf swing and to retrieve golf balls from the water.

2. Description of the Prior Art

The use of an umbrella and golf ball retrieving device is known in the prior art. More specifically, an umbrella and golf ball retrieving device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,511,147; U.S. Pat. No. 5,480,146; U.S. Pat. No. Des. 395,477; U.S. Patent No. Des. 365,131; U.S. Pat. No. 5,657,985; and U.S. Pat. No. 5,261,434.

While these devices fulfill their respective, particular objectives and requirements, the aforementioned patents do not disclose a new golf swing training umbrella and golf ball retrieving device. The inventive device includes an elongate support assembly having a tubular base member and a plurality of tubular sections telescopingly disposed in said tubular base member and having an innermost tubular section and an outermost tubular section; and also includes a cover support assembly being collapsibly attached to a first end of the tubular base member; and further includes a cover member being securely supported upon said the cover support assembly; and also includes a hand-grip member being securely and removably disposed about the elongate support assembly; and further includes a golf ball retrieval assembly being securely and removably attached to an end of the outermost tubular section.

In these respects, the golf swing training umbrella and golf ball retrieving device according to the present invention substantially departs from the conventional concepts and designs of the prior art, and in so doing provides an apparatus primarily developed for the purpose of allowing the user to practice one's golf swing and to retrieve golf balls from the water.

SUMMARY OF THE INVENTION

In view of the foregoing disadvantages inherent in the known types of umbrella and golf ball retrieving device now present in the prior art, the present invention provides a new golf swing training umbrella and golf ball retrieving device construction wherein the same can be utilized for allowing the user to practice one's golf swing and to retrieve golf balls from the water.

The general purpose of the present invention, which will be described subsequently in greater detail, is to provide a new golf swing training umbrella and golf ball retrieving device which has many of the advantages of the umbrella and golf ball retrieving device mentioned heretofore and many novel features that result in a new golf swing training umbrella and golf ball retrieving device which is not anticipated, rendered obvious, suggested, or even implied by any of the prior art umbrella and golf ball retrieving device, either alone or in any combination thereof.

To attain this, the present invention generally comprises an elongate support assembly having a tubular base member and a plurality of tubular sections telescopingly disposed in said tubular base member and having an innermost tubular section and an outermost tubular section; and also includes a cover support assembly being collapsibly attached to a first end of the tubular base member; and further includes a cover member being securely supported upon said the cover support assembly; and also includes a hand-grip member being securely and removably disposed about the elongate support assembly; and further includes a golf ball retrieval assembly being securely and removably attached to an end of the outermost tubular section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf swing training umbrella and golf ball retrieving device which has many of the advantages of the umbrella and golf ball retrieving device mentioned heretofore and many novel features that result in a new golf swing training umbrella and golf ball retrieving device which is not anticipated, rendered obvious, suggested, or even implied by any of the prior art umbrella and golf ball retrieving device, either alone or in any combination thereof.

It is another object of the present invention to provide a new golf swing training umbrella and golf ball retrieving device which may be easily and efficiently manufactured and marketed.

It is a further object of the present invention to provide a new golf swing training umbrella and golf ball retrieving device which is of a durable and reliable construction.

An even further object of the present invention is to provide a new golf swing training umbrella and golf ball retrieving device which is susceptible of a low cost of manufacture with regard to both materials and labor, and which accordingly is then susceptible of low prices of sale to the consuming public, thereby making such golf swing training umbrella and golf ball retrieving device economically available to the buying public.

Still yet another object of the present invention is to provide new golf swing training umbrella and golf ball retrieving device which provides in the apparatuses and methods of the prior art some of the advantages thereof, while simultaneously overcoming some of the disadvantages normally associated therewith.

Still another object of the present invention is to provide a new golf swing training umbrella and golf ball retrieving device for allowing the user to practice one's golf swing and to retrieve golf balls from the water.

Yet another object of the present invention is to provide a new golf swing training umbrella and golf ball retrieving device which includes an elongate support assembly having a tubular base member and a plurality of tubular sections telescopingly disposed in said tubular base member and having an innermost tubular section and an outermost tubular section; and also includes a cover support assembly being collapsibly attached to a first end of the tubular base member; and further includes a cover member being securely supported upon said the cover support assembly; and also includes a hand-grip member being securely and removably disposed about the elongate support assembly; and further includes a golf ball retrieval assembly being securely and removably attached to an end of the outermost tubular section.

Still yet another object of the present invention is to provide a new golf swing training umbrella and golf ball retrieving device that allows the user to be able practice one's golf swing without using an actual golf club.

Even still another object of the present invention is to provide a new golf swing training umbrella and golf ball retrieving device that is easy and convenient to use and has a hand-grip member like that used to grip a golf club.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
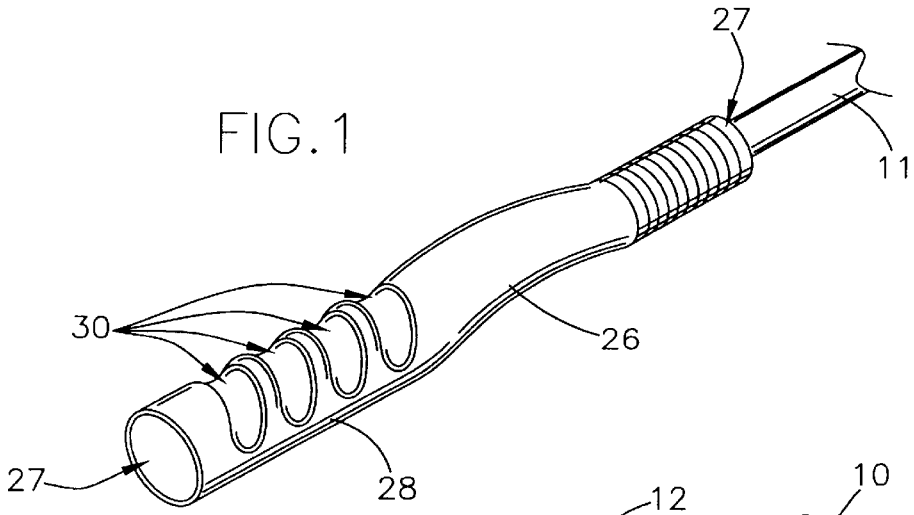
FIG. 1 is a perspective view of a the hand-grip member of a new golf swing training umbrella and golf ball retrieving device according to the present invention.
Figure 2:
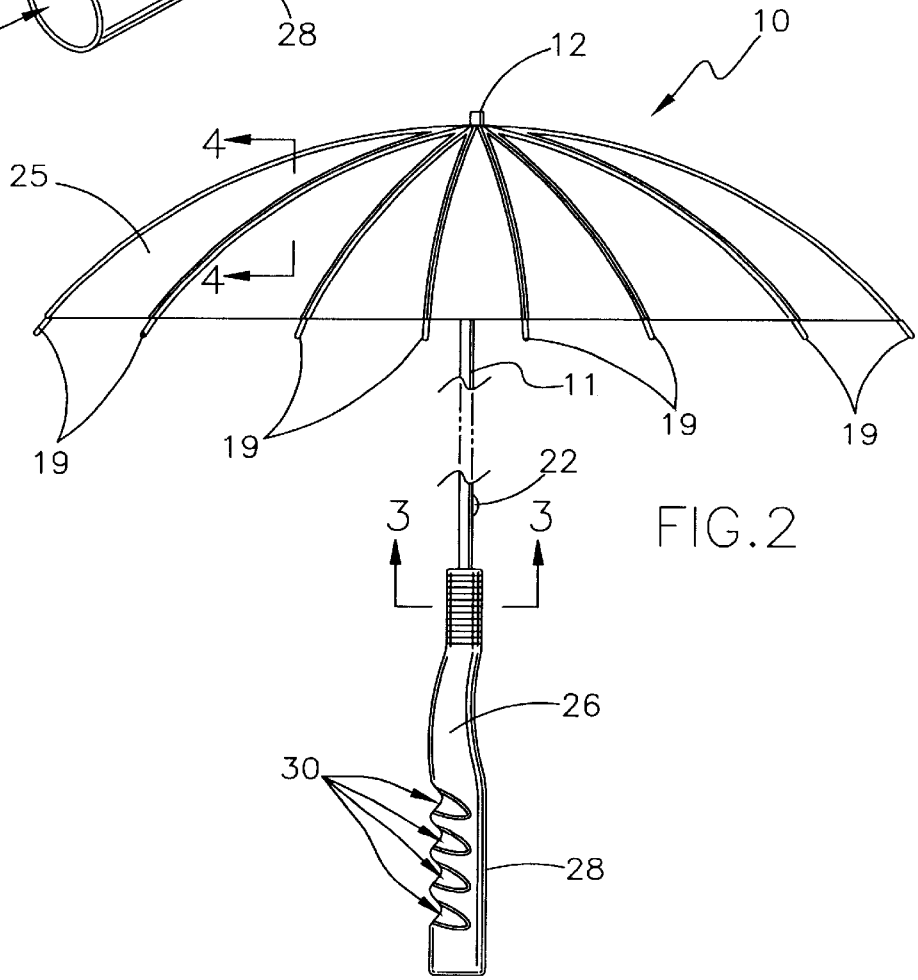
FIG. 2 is a side elevational view of the present invention.
Figure 3:
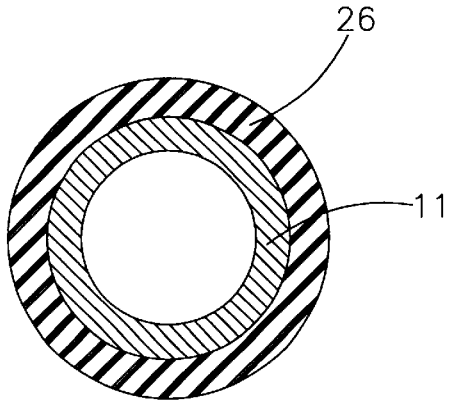
FIG. 3 is a cross-sectional view of tubular base member and the hand-grip member of the present invention.
Figure 4:
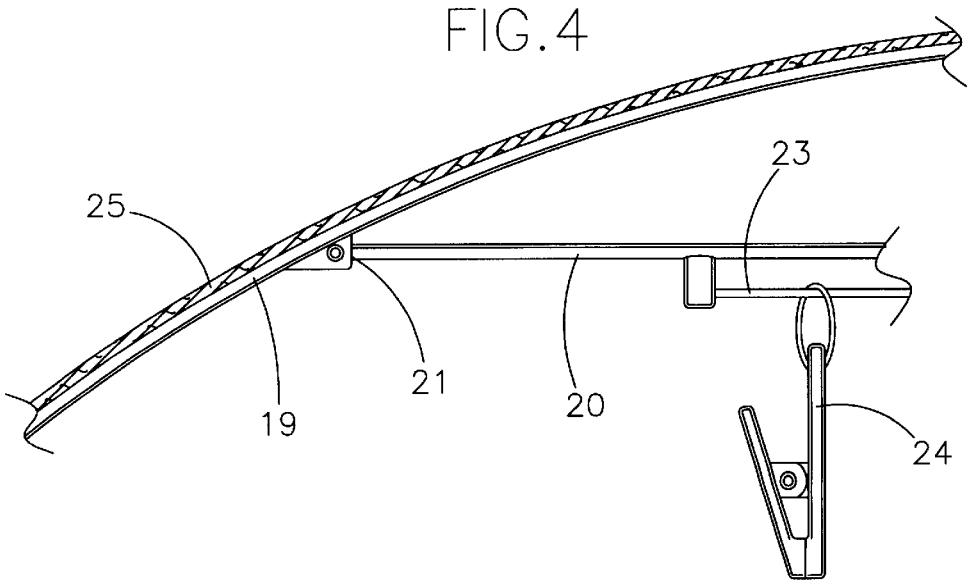
FIG. 4 is a partial side elevational view of the cover support assembly and the cover member of the present invention.
Figure 5:
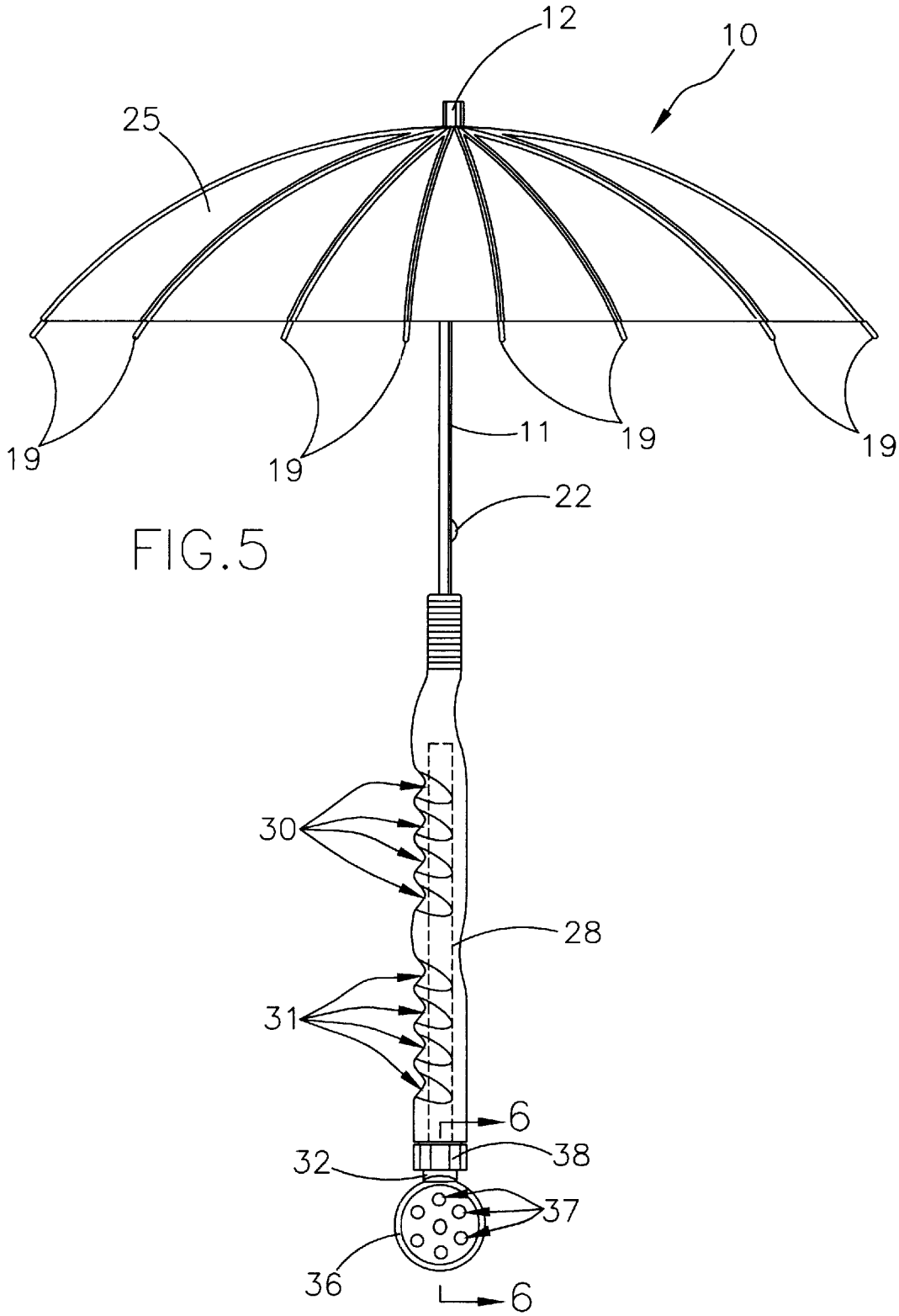
FIG. 5 is a side elevational view of the present invention showing the golf ball retriever assembly fastened to the support assembly.
Figure 6:
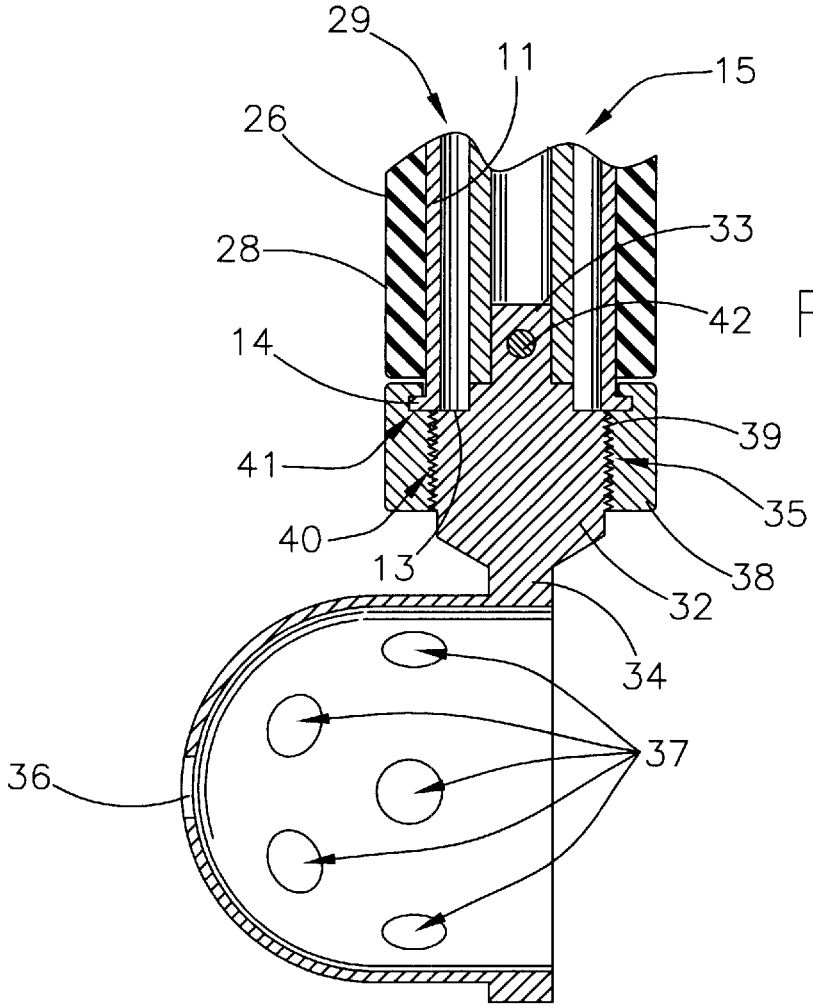
FIG. 6 is a cross-sectional view of the second end of the support assembly of the present invention.
Figure 7:
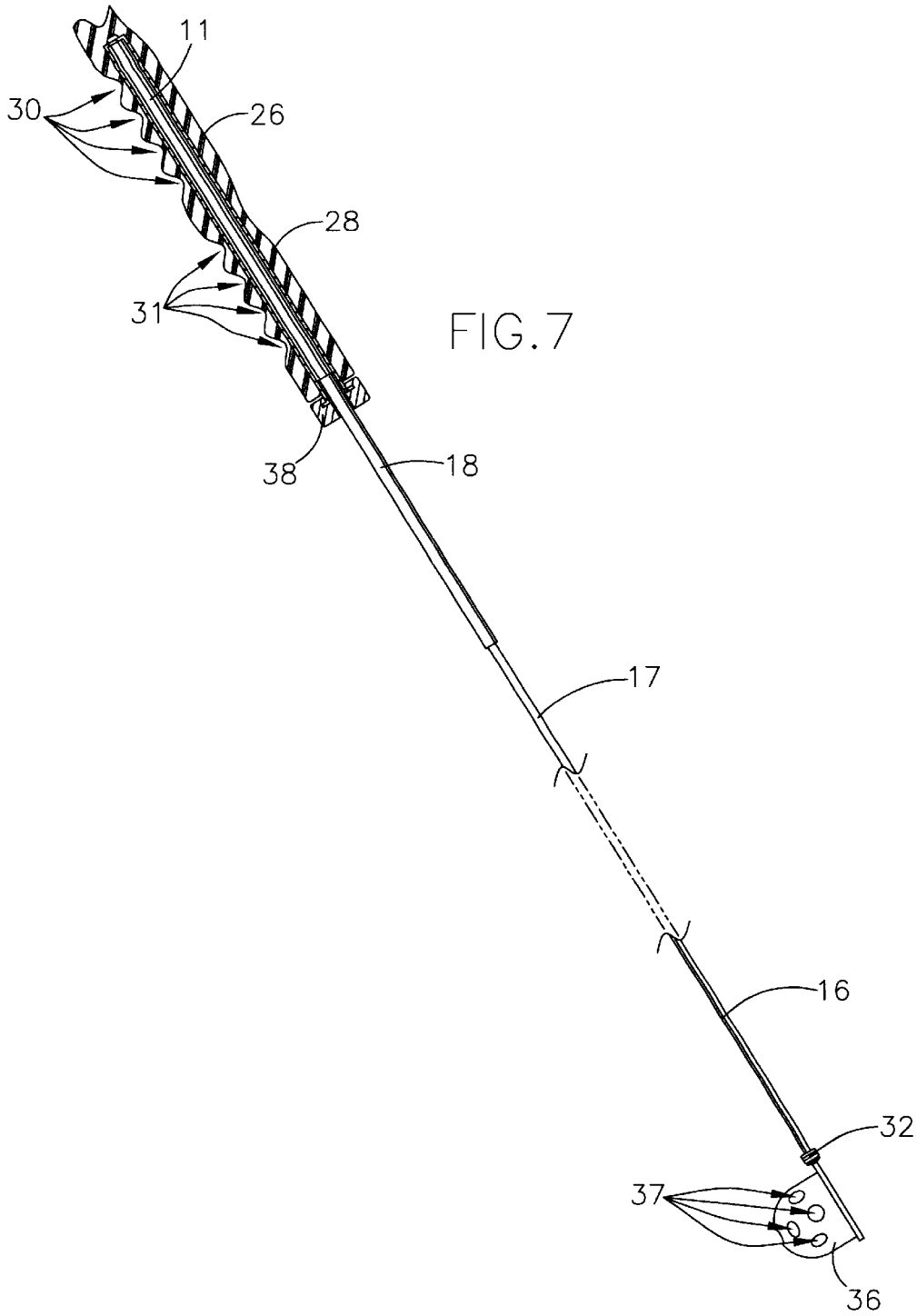
FIG. 7 is a side elevational view of the present invention showing the extension of the tubular sections and the golf ball retrieval member.

With reference now to the drawings, and in particular to FIGS. 1 through 7 thereof, a new golf swing training umbrella and golf ball retrieving device embodying the principles and concepts of the present invention and generally designated by the reference numeral 10 will be described.

As best illustrated in FIGS. 1 through 7, the golf swing training umbrella and golf ball retrieving device 10 generally comprises a support assembly having a tubular base member 11 and a plurality of tubular sections 16–18 telescopingly disposed in the tubular base member 11 and having an innermost tubular section 18 and an outermost tubular section 16. The tubular base member 11 includes an open second end 13 and a bore 15 extending therein through the open second end 13 with the innermost tubular section 18 being movably disposed in and extendable from the tubular base member 11 through the open second end 13. The tubular sections 16–18 also include intermediate tubular sections 17 with each of the intermediate and outermost tubular sections 16,17 being movably received in and extendable from another of the tubular sections 16–18. The tubular base member 11 also includes an annular flange 14 securely and integrally disposed upon and extending thereabout at the open second end 13.

A cover support assembly is collapsibly attached to a first end 12 of the tubular base member 11. The cover support assembly includes a plurality of radially-extending support members 19 having ends pivotally attached to the tubular base member 11, and also includes brace members 20 having first ends 21 pivotally attached to one or more of the radially-extending elongate support members 19, and further includes a brace support member which is essentially a ring member being movably and lockingly disposed about a portion of the tubular base member 11 and being securely and conventionally attached to second ends of the brace members 20, and also includes latch members 22 being conventionally disposed in and biasedly disposed outwardly of the tubular base member 11, and further includes an elongate clip support member 23 being securely and conventionally attached to one of the brace members 20, and also includes a clip member 24 being movably attached along the elongate clip support member 23 for supporting and holding a towel. A cover member 25 is securely and conventionally supported upon the cover support assembly with the cover member 25 being essentially a sheet of material. One of the latch members 22 is used to lock the brace support member at a position which deploys the cover member 25.

A hand-grip member 26 is securely and removably disposed about the support assembly with the hand-grip member 26 being essentially a rubberized tubular member having a side wall 28, open ends 27 and a bore 29 extending therethrough. The hand-grip member 26 also has a plurality of finger-receiving grooves 30,31 being disposed in and spaced along a length of the side wall 28. The finger-receiving grooves 30,31 include two sets of the finger-receiving grooves 30,31 with each of the sets having four finger-receiving grooves 30,31. The sets 30,31 of the finger-receiving grooves are spaced apart from one another with one 31 of the sets being adapted to receive the user's fingers of one's right hand and with the other 30 of the sets being adapted to receive the user's fingers of one's left hand with the user gripping the hand-grip member 26 as one would grip a golf club.

A golf ball retrieval assembly is securely and removably attached to an end of the outermost tubular section 16 with the golf ball retrieval assembly including a tubular bracket member 32 having an extended first end portion 33 which is securely fastened with a fastener 42 to an end of the outermost tubular section 16, and also having an extended second portion 34, and further having threads 35 disposed upon an outer surface thereof, and also including a golf ball retrieval member 36 which is securely and conventionally attached to the extended second end portion 34, and further including a threaded bracket fastening member 38 which is securely attached to the tubular base member 11 and is threaded upon the bracket member 32 to prevent the tubular sections 16–18 from being extended. The bracket fastening member 38 is essentially a ring having a hole therethrough and a wall 39 defining the hole and having threads 40 disposed thereupon and also having an annular groove 41 disposed therein with the annular groove 41 being adapted to securely receive and retain the annular flange 14 of the tubular base member 11. The golf ball retrieval member 36 is essentially a cup-like member capable of picking up and securely holding a golf ball with the cup-like member having a plurality of holes 37 disposed therethrough to allow water to drain from the cup-like member 36.

In use, the user would grasp the hand-grip member 26 much like he would grasp the handle of a golf club and could swing the umbrella and golf ball retrieval device 10 like one would swing a golf club to practice one's golf swing. To use the umbrella, the user would simply move the brace support member along the tubular base member 11 and lock it with one of the latch members 22. To use the golf ball retrieval member 36, the user would unscrew the bracket fastening member 38 from the tubular bracket member 32 and extend the tubular sections 16–18 to capture a golf ball in water such as a creek, a pond, or a lake.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf swing training umbrella and golf ball retrieving device comprising:

a support assembly having a base member and a plurality of tubular sections telescopically disposed in said base member and having an innermost tubular section and an outermost tubular section;

a cover support assembly being collapsibly attached to a first end of said base member;

a cover member being securely supported upon said cover support assembly;

a hand-grip member being securely and removably disposed about said support assembly;

a golf ball retrieval assembly being securely and removably attached to an end of said outermost tubular section, said retrieval assembly including a bracket member having a first end portion being attached to said end of said outermost tubular section of said support assembly, said bracket member having threads disposed upon an outer surface thereof;

said retrieval assembly including a bracket fastening member being attached to said base member and being threadably couplable to said bracket member such that each of said tubular sections is restricted from extending away from said base member, said bracket fastening member comprising an annular member having a threaded internal wall for selectively coupling to said outer surface of said bracket member;

said base member including an annular flange being disposed upon and extending thereabout an open second end of said base member; and said bracket fastening member having an annular groove disposed therein for receiving said annular flange of said base member, wherein said bracket fastening member is permitted to rotate freely about said second end of said base member such that said bracket fastening member and said bracket member are selectively couplable when said bracket fastening member is rotated.

2. A golf swing training umbrella and golf ball retrieving device as described in claim 1, wherein said base member includes an open second end and a bore extending therein through said open second end, said innermost tubular section being movably disposed in and extendable from said base member through said open second end.

3. A golf swing training umbrella and golf ball retrieving device as described in claim 1, wherein said plurality of said tubular sections also include intermediate tubular sections, each of said intermediate and outermost tubular sections being movably received in and extendable from another of said tubular sections.

4. A golf swing training umbrella and golf ball retrieving device as described in claim 1, wherein said cover support assembly includes a plurality of radially-extending elongate support members having ends pivotally attached to said base member, and also includes brace members having first ends pivotally attached to one or more of said radially-extending elongate support members, and further includes a brace support member which is essentially a ring member being movably and lockingly disposed about a portion of said base member and being securely attached to second ends of said brace members, and also includes latch members being disposed in and biasedly disposed outwardly of said base member for locking said brace support member at a position which deploys said cover member.

5. A golf swing training umbrella and golf ball retrieving device as described in claim 4, further comprising an elongate clip support member being securely attached to one of said brace members, and also including a clip member being movably attached along said elongate clip support member for supporting and holding onto a towel.

6. A golf swing training umbrella and golf ball retrieving device as described in claim 1, wherein said cover member comprises a flexible sheet of generally water-resistant material.

7. A golf swing training umbrella and golf ball retrieving device as described in claim 1, wherein said hand-grip member is essentially a rubberized tubular member having a side wall, open ends and a bore extending therethrough, said hand-grip member also having a plurality of finger-receiving grooves being disposed in and spaced along a length of said side wall.

8. A golf swing training umbrella and golf ball retrieving device as described in claim 7, wherein said finger-receiving grooves includes two sets of said finger-receiving grooves with each of said sets having four of said finger-receiving grooves, said sets of said finger-receiving grooves being spaced apart from one another with one of said sets being adapted to receive the user's fingers of one's right hand and with the other of said sets being adapted to receive the user's fingers of one's left hand with the user gripping said hand-grip member as one would grip a golf club.

9. A golf swing training umbrella and golf ball retrieving device as described in claim 1, said retrieval assembly including a golf ball retrieval member being attached to said second end portion of bracket member;

wherein said golf ball retrieval member is essentially a cup-like member capable of picking up and securely holding a golf ball, said cup-like member having a plurality of holes disposed therethrough to allow water to drain from said cup-like member.

10. A golf swing training umbrella and golf ball retrieving device comprising:

a support assembly having a base member and a plurality of tubular sections telescopically disposed in said base member and having an innermost tubular section and an outermost tubular section;

a cover support assembly being collapsibly attached to a first end of said base member;

a cover member being securely supported upon said cover support assembly, wherein said cover member comprises a flexible sheet of generally water-resistant material;

a hand-grip member being securely and removably disposed about said support assembly; and a golf ball retrieval assembly being securely and removably attached to an end of said outermost tubular section, said retrieval assembly including a bracket member having a first end portion being attached to said end of said outermost tubular section of said support assembly, said bracket member having threads disposed upon an outer surface thereof;

said retrieval assembly including a bracket fastening member being attached to said base member and being threadably couplable to said bracket member such that each of said tubular sections is restricted from extending away from said base member, said bracket fastening member comprising an annular member having a threaded internal wall for selectively coupling to said outer surface of said bracket member;

said base member including an annular flange being disposed upon and extending thereabout an open second end of said base member;

said bracket fastening member having an annular groove disposed therein for receiving said annular flange of said base member, wherein said bracket fastening member is permitted to rotate freely about said second end of said base member such that said bracket fastening member and said bracket member are selectively couplable when said bracket fastening member is rotated;

wherein said base member includes an open second end and a bore extending therein through said open second end, said innermost tubular section being movably disposed in and extendable from said base member through said open second end;

wherein said plurality of said tubular sections also include intermediate tubular sections, each of said intermediate and outermost tubular sections being movably received in and extendable from another of said tubular sections;

wherein said cover support assembly includes a plurality of radially-extending elongate support members having ends pivotally attached to said base member, and also includes brace members having first ends pivotally attached to one or more of said radially-extending elongate support members, and further includes a brace support member which is essentially a ring member being movably and lockingly disposed about a portion of said base member and being securely attached to second ends of said brace members, and also includes latch members being disposed in and biasedly disposed outwardly of said base member for locking said brace support member at a position which deploys said cover member;

a cover member being securely supported upon said cover support assembly, wherein said cover member comprises a flexible sheet of generally water-resistant material;

wherein said hand-grip member is essentially a rubberized tubular member having a side wall, open ends and a bore extending therethrough, said hand-grip member also having a plurality of finger-receiving grooves being disposed in and spaced along a length of said side wall;

wherein said finger-receiving grooves includes two sets of said finger-receiving grooves with each of said sets having four of said finger-receiving grooves, said sets of said finger-receiving grooves being spaced apart from one another with one of said sets being adapted to receive the user's fingers of one's right hand and with the other of said sets being adapted to receive the user's fingers of one's left hand with the user gripping said hand-grip member as one would grip a golf club;

said retrieval assembly including a golf ball retrieval member being attached to said second end portion of bracket member;

wherein said golf ball retrieval member is essentially a cup-like member capable of picking up and securely holding a golf ball, said cup-like member having a plurality of holes disposed therethrough to allow water to drain from said cup-like member; and an elongate clip support member being securely attached to one of said brace members, and also including a clip member being movably attached along said elongate clip support member for supporting and holding onto a towel.

* * * * *